US005433365A

United States Patent [19]

Davies

[11] Patent Number: 5,433,365

[45] Date of Patent: Jul. 18, 1995

[54] FLUID NOZZLE DEVICE FOR YARN PROCESSING

[75] Inventor: John Davies, Cesate, Italy

[73] Assignee: Filteco S.P.A., Italy

[21] Appl. No.: 942,315

[22] Filed: Sep. 8, 1992

[30] Foreign Application Priority Data

Sep. 18, 1991 [IT] Italy ..... MI91A2470

[51] Int. Cl.[6] ..... B65H 20/10; B65H 20/14

[52] U.S. Cl. ..... 226/97; 28/273; 28/274; 28/276; 57/333; 57/350; 137/891; 226/7; 254/134.4

[58] Field of Search ..... 226/7, 97; 254/134.4; 57/333, 350; 28/271, 273, 274, 276; 34/155; 137/888, 891

[56] References Cited

U.S. PATENT DOCUMENTS

| | | | |
|---|---|---|---|
| 2,812,850 | 11/1957 | Pape | 57/333 |
| 2,994,938 | 8/1961 | Loveland et al. | 28/1 |
| 3,156,395 | 11/1964 | Ashby et al. | 226/7 |
| 3,486,318 | 12/1969 | Cannon et al. | 57/333 |
| 3,559,860 | 2/1971 | East et al. | 276/97 |
| 3,754,694 | 8/1973 | Reba | 226/97 |
| 4,069,562 | 1/1978 | Trifunovic et al. | 28/273 |
| 4,181,247 | 1/1980 | McFall | 226/97 |
| 4,282,637 | 8/1981 | Mosseri et al. | 28/254 |
| 4,295,253 | 10/1981 | Knopp et al. | 28/255 |
| 4,492,009 | 1/1985 | Agers et al. | 28/254 |
| 4,507,833 | 4/1985 | Simmen | 28/254 |
| 4,521,945 | 6/1985 | Heinen et al. | 28/273 |
| 4,547,938 | 10/1985 | Cullen et al. | 28/254 |
| 4,574,436 | 3/1986 | Cullen, Jr. | 28/254 |
| 4,807,431 | 2/1989 | Braxmeier | 57/333 |
| 4,856,691 | 8/1989 | Takehana et al. | 226/91 |

FOREIGN PATENT DOCUMENTS

| | | | |
|---|---|---|---|
| 0010229 | 4/1980 | European Pat. Off. . | |
| 2856291 | 3/1980 | Germany . | |
| 47-16270 | 5/1972 | Japan | 28/274 |
| 404072 | 12/1965 | Switzerland . | |
| 0431801 | 3/1967 | Switzerland | 28/273 |
| 811373 | 4/1959 | United Kingdom . | |
| 871797 | 6/1961 | United Kingdom . | |
| 2005737 | 4/1979 | United Kingdom . | |

*Primary Examiner*—Daniel P. Stodola
*Assistant Examiner*—William Stryjewski
*Attorney, Agent, or Firm*—Wigman, Cohen, Leitner & Myers

[57] ABSTRACT

A nozzle device for processing of synthetic yarns for intermingling or texturization. The nozzle device has a housing with an inlet end and an outlet end. The inlet end is located upstream in relation to the outlet end. An inner nozzle member is provided and has a conical outer wall portion and an essentially axial passage. An outer nozzle member is provided and has a conical inner wall portion. Both inner and outer nozzle members are kept in position within the housing. The conical outer wall section of the inner nozzle member and the inner wall portion of the outer nozzle member together form an outwardly conical gap having an upper or upstream end and a lower or downstream end. Inlet conduits or ducts are provided for passing a fluid into the housing and into a region thereof adjacent the upper end of the conical gap. The conical gap is defined by a generally annular cross-sectional area in any radial plane between the upper and the lower end of the gap. Structures are provided to form at least one flow-differential within the gap.

7 Claims, 2 Drawing Sheets

FLUID NOZZLE DEVICE FOR YARN PROCESSING

BACKGROUND OF THE INVENTION

1. Field of the Invention

This invention generally relates to devices for and methods of contacting solids with fluids and specifically to nozzle devices, i.e. apparatus means including a nozzle or jet which is operated with a fluid that may but need not be gaseous.

2. Prior Art

Nozzle devices are widely used in yarn processing and this is a preferred yet not the only field of interest for the present invention. For example, yarns that comprise or consist of man-made fibres including all-synthetic fibres frequently require some treatment involving texturizing and/or intermingling of the filaments, or filament groups, which together form the multifilament product yarn, and a common element of such treatment is contacting the yarn with a fluid, such as air or steam, generally under high-temperature and high-pressure or high-turbulence conditions of the fluid.

Typically, conventional nozzle devices constitute the inlet portion of a texturizing system, also termed jet system, normally operating with hot air or steam; the purpose of such systems is to first plasticise the yarn and then to submit it to the impact of pressure and/or turbulence so as to deform the yarn for imparting crimp and to obtain a more bulky yarn product. Essentially, a texturizing system thus consists of a first portion, also termed induction side of the system, for taking the yarn into and through a channel, and of a second portion, e.g. a chamber which provides for a larger area into which the yarn is forwarded at high velocities and where the yarn is forced against blades or chamber segments so as become crimped or otherwise modified under heat and pressure.

However, commercially available texturizing jet systems tend to exhibit problems at the induction side, notably when processing yarns that consist of differing filaments, such as multicolored yarns consisting of filament portions that are differently coloured, e.g. melt-spun in groups from polymers admixed with various colours or dyes, or consist of differing polymer species. Very small irregularities caused in the manufacture or by wear of the jets may cause rather substantial flow differences tending to cause irregular induction and convection of the processed yarns. For example, when processing yarns composed of differently coloured filament groups, irregular induction tends to change the positional filament order, i.e. the relative positions of the yarn constituent fibres, and only in a yarn consisting of identical filaments would such changes be without detrimental consequences. As soon as differing filaments or filament groups are used, a change of the positional order of the filaments in the yarn tends to change the visible or tangible yarn properties, e.g. colour appearance, and cause subsequent problems of quality, uniformity, and colour variation.

Since it is the exception rather than the rule that different jets (e.g. at different parts of the same production plant) behave identically with regard to induction, it will be understood that nozzle structure and nozzle operation can pose extremely important problems in many fields of yarn production if consistent and reproducible quality parameters are to be achieved.

OBJECTS AND SUMMARY OF THE INVENTION

Accordingly, it is a main object of the invention to provide for a nozzle device capable of eliminating these drawbacks and of providing uniform and reproducible induction with an individual nozzle device, or with any number of parallel-operating nozzle devices, used in a given plant e.g. when processing multifilament yarns composed of differing filament groups in a plant that may produce 8, 12, 16 or more yarns in parallel operation and, hence, requires a corresponding number of parallel nozzle devices.

Now, it has been found according to the invention that the above objects and further advantages can be achieved in a nozzle device of the type having:

(A) a housing with an upstream inlet end and a downstream outlet end;

(B) an inner nozzle member with a conical outer wall portion and an essentially axial passage connected to the housing;

(C) an outer nozzle member, also connected with the housing, having a conical inner wall portion;

(D) an essentially conical gap with an upper and a lower end formed between the conical outer wall section of the inner nozzle member and the inner wall portion of the outer nozzle member; the configuration of the gap being defined by a cross-sectional area in any radial plane between the upper and the lower end of the gap;

(E) inlet means for passing a fluid into the housing and into a region adjacent the upper end of the conical gap; (F) and means for providing at least one pressure-differential area within said cross-sectional area of said gap.

According to a general embodiment of the invention, the novel nozzle device, because of the at least one pressure-differential area in the gap, provides for at least one differential pressure drop within the gap (indicated by at least two gap areas each providing for a different pressure or flow velocity within the gap) and, hence, for at least two longitudinally adjacent gap zones of differing velocities of the fluid. While no general theory is intended, it is assumed that such pressure or velocity gradients are capable of acting as dynamic "flow guides" within the gap providing for a controlled and reproducible flow of the fluid plus yarn into the gap and any subsequent yarn-processing jet so as to maintain control over "yarn positioning", i.e. the location of the various filament components within the product yarn as explained above.

As a result, a consistent uniform order of colour and/or polymer constituents can be achieved in the production or processing of multicolored and/or multi-polymer yarns by using a nozzle device as taught by the present invention. Further applications and advantages of the invention will become apparent as the specification proceeds.

DEFINITIONS AND PREFERRED EMBODIMENTS OF THE INVENTION

Preferred embodiments that will be discussed in more detail below provide for dynamic gap flow control by achieving "linear" i.e. essentially axial, flow direction or, if desired, in helical directions to achieve, or control, twisting of the yarn.

In this general context it is to be noted that the term "axial" with reference to the conical gap is to be understood in the sense that the main vector of flow motion along the gap is in axial direction while only a relatively minor vector will be in radial direction in line with the conical form of the gap. Further, regarding the term "conical" it is to be noted that this is intended to refer to a gap having an outer configuration that is conical and converges or tapers down to a point where the outer diameter reaches a predetermined minimum.

Accordingly, the inner gap configuration may, but need not, converge in the sense that the difference between the outer and inner diameter of the gap also becomes smaller in flow direction, i.e. toward the minimum value of the outer diameter. Frequently, the outer diameter of the gap will reach its minimum near the lower end of the inner nozzle member, i.e. where the gap looses its essentially annular character and becomes an essentially circular area; again, however, this is a preferred rather than a critical feature of the invention.

Different structural variations or modifications may be used according to the invention to generate pressure-differential areas within cross-sectional gap areas, all of which may be assumed, for explanation purposes, to have essentially annular shapes of continually diminishing (downwards when viewed in the direction of flow) outer and inner diameters which may, but do not need to, have substantially the same "width" (=difference between outer and inner diameter); as a matter of practicing the invention, pressure-differential areas may be caused by various structural features of the new nozzle device, such as locally varying the axial length and/or the radial width of the gap. For example, at least one gap area may have a reduced axial length and/or reduced radial width, and both or one of the outer and inner nozzle members may be structurally modified to achieve this.

In an embodiment of the invention preferred for structural simplicity and operational effectivity the outer nozzle member has at least one, and preferably two peripheral recess(es) in axial direction near the upper end of the gap for providing at least one area along said gap where the flow resistance for the fluid medium is decreased locally because of the locally decreased length where the fluid enters at a lower level, i.e. through the recess(es).

According to another embodiment of the invention, the inner and/or the outer nozzle member is provided with one or more grooves or ridges so as to cause "contractions" or "bulbs" of the annular (i.e. when viewed cross-sectionally in a radial plane) the groove(s) or ridge(s) extend along a portion, at least, of the axial length of the conical gap.

The term "axial recess" is intended to refer to a recess or indentation in a generally axial direction as dictated, for example, by the general shape of the outer nozzle member; preferably, at least two such axial recesses are provided at the "upper rim" of the outer nozzle member, i.e. at the upper end of the conical gap where the fluid medium enters into the gap.

For many purposes it is preferred to arrange such recesses in an essentially symmetrical, i.e mutually equidistanced distribution. Thus, with a pair of recesses a peripheral distance of about 180° is provided between the two recesses; three recesses would be distanced by 120° and four recesses by 90°. However, the flow control effect may decrease if too many recesses are used.

Further, the invention provides a novel method of processing multifilament yarns by passage through a texturizing system comprising a nozzle device with dynamic flow control in the conical gap as indicated above. The method of the invention provides most substantial benefits when used for manufacture of multifilament yarns including at least two and typically three to 6 different filament groups, or if uniform and reproducible intermingling is essential for other reasons except colour uniformity.

EXPLANATION OF THE DRAWINGS

The invention will now be explained by way of example, not limitation, with reference to the enclosed drawings in which:

FIG. 1A shows an axial cross-sectional view, somewhat simplified, of a working example of a nozzle device 1 according to the invention. It is made, essentially, of a structural material, such as stainless steel, ceramics or the like, and comprises an outer housing 11 having an "upper" end 111 and a "lower" end 112. The main functions of housing 11 are these: (I) to hold the inner nozzle member 12 in operative connection with the outer nozzle member 14 so as to form conical gap 16; (II) to permit passage of a fluid medium such as hot air or steam through inlet 18 into the essentially cylindrical space formed between inner portions of housing 11 and outer portions of outer nozzle member 14 where longitudinal recesses or ducts 147*a*, 148*a* (FIG. 1B), 147*a*, 148*a*, 147*b* (FIG. 1C) may be provided in the upper part of the outer nozzle member 14 for passage of the fluid to the "upper" end 161 of gap 16; and (III) to pass an essentially endless stream of a solid material, such as a multifilament strand emanating from a filaments-producing or filaments-processing device or plant arranged "upstream" of nozzle device 1, into duct 144 for induction by and interaction with the fluid. An expansion space 13 at the "lower" end of duct 144 is indicated in broken lines but is prior art and forms no part of the present invention.

Figure 1A:
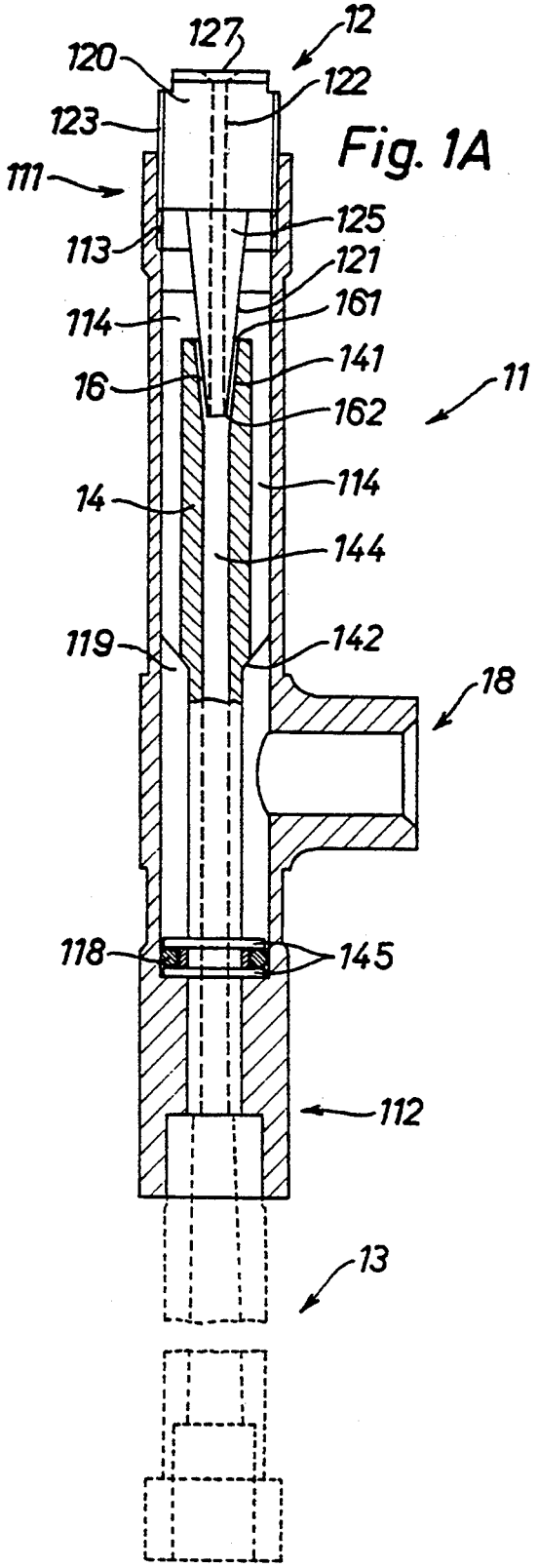
FIG. 1A is a semi-diagrammatic cross-sectional view, taken in an axial plane, of a nozzle device according to the invention.

Inner nozzle member 12 comprises an upper cylindrical body 120 with an external thread 123 and an internal axial bore or passage 122 having an upper "port" or entry 127; a corresponding thread 113 of the housing permits positioning of member 12 relative to the housing and/or to the outer nozzle member 14. Nozzle member 12 further comprises a lower part 125 with an outwardly conical shape. The lowest portion of conical portion 125 extends into outer nozzle member 14 so as to form gap 16 between the outer surface 121 of inner nozzle member 12 and the inner surface 141 of outer nozzle member 14. Depending upon the pressure of the fluid and, consequently, the velocity of the fluid passing through gap 16, a zone of reduced pressure, i.e. strong suction is generated at the lower end of duct 122, and a stream of a solid, such as a multifilament strand (yarn or yarn predecessor, not shown in the drawing) that is fed into port 127 of duct 122 will then be conveyed into and through duct 144, together with any ambient fluid (normally air) near port 127 depending upon the outer diameter as well as bulk density, or interstice volume, of the strand.

Accordingly, the fluid medium passed into the "cylindrical space" 114 within housing 11 adjacent the upper gap end 161 serves a double function, namely to convey or induct the feed strand into nozzle device 11, and to condition or otherwise modify the processed solids material for subsequent texturization in a downstream apparatus, such as expansion device 13.

It should be noted here again that yarn texturization is but one application of the invention, though a preferred one; accordingly, interaction of the fluid with the solid while passing through nozzle device is a preferred but not an essential feature of the invention. In other words, the inventive teaching is primarily concerned with flow conditions within gap 16 and dynamic flow guidance therein, while any other interaction between the fluid and the processed solid material is secondary.

By the same token, while both nozzle members 12, 14 must have gap-forming surfaces 121, 141, they may but need not have additional functions, such as providing an entry port 127 into housing 11, or positioning within housing 11, e.g. by means of a thread 123 and stop faces 142 abutting with housing shoulders 119, or other features including e.g. fluid ducts 147*a*, 148*a* (FIG. 1B), 147*a*, 148*a*, 147*b* (FIG. 1C) channel tube 146 and sealing means, e.g. distancing disks 145 plus O-ring 118. In fact, all such secondary functions could be provided by separate elements in operative connection with the essential gap forming surfaces 121, 141.

Figure 1B:
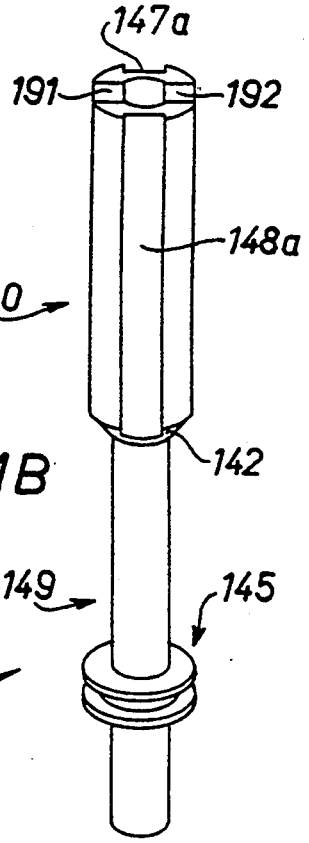
FIG. 1B is a perspective side view of the outer nozzle member forming part of the nozzle device of FIG. 1A.
Figure 1C:
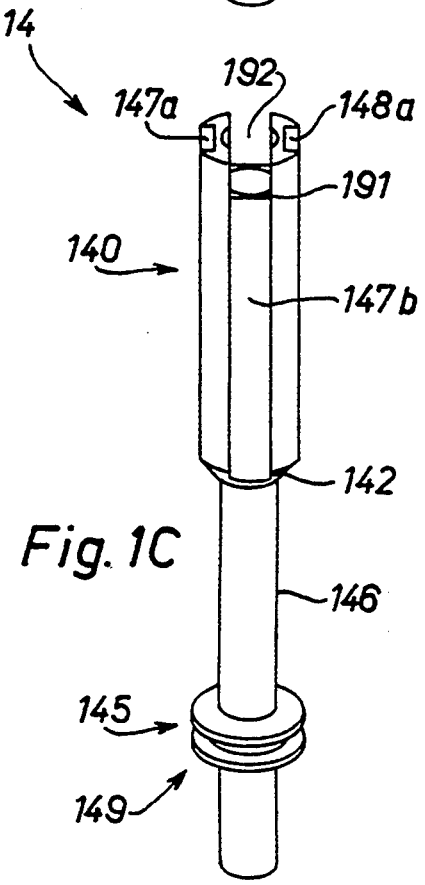
FIG. 1C is another perspective side view of the nozzle shown in FIG. 1B, turned by 90° around the longitudinal axis to show the recesses embodying a preferred dynamic gap flow control means according to the invention.

FIGS. 1B and 1C illustrate preferred details of the multi-functional outer nozzle member 14 shown in FIG. 1A. Dynamic flow control according to the invention is achieved by a pair of "indentations", "pinnacles" or "windows", e.g. analogous in shape to the archery windows at the upper edge of the castle of a tower, i.e. axial recesses 191,192 at the upper end of the nozzle-forming portion of member 14. As a consequence, the axial length of each gap portion downstream of each recess 191,192 will be "shortened" by the axial length of each recess 191,192 and, as a consequence, the flow resistance of the gap portion "below" each recess will be diminished. In other words, two pressure differential or pressure drop areas will be formed and extend over a part, at least of the axial length of the gap.

Preferably, the axial length or depth of each recess 191, 192 is significant in relation to the length of gap 16 in axial direction, i.e between its upper end 161 and its lower end 162. For many purposes of the invention, the axial length of each recess 191,192 will be in the range of from about 10% to about 50% of the entire axial length of gap 16. An axial length of recesses 191,192 of about 30% of the entire gap length is a preferred specific example. The "width" or peripheral length of each recess 191,192 may be in the range of from about 30° (referring to a circle periphery of 360°) to about 160°, e.g. about 120° and preferably corresponds to at least about 90° of the gap periphery.

Symmetrical arrangements or substantially equidistant positions of substantially equally dimensioned recesses are preferred for structural simplicity. Selection of the total number of recesses may depend upon absolute dimensions. A minimum number of two recesses is frequently preferred but, since typical maximum outer diameters of gap 16 are in the range of 5 to 10 mm, more than 4 recesses will not generally improve dynamic gap flow control and are less preferred Also, a few "wide" (e.g. 90°–150° of periphery) recesses are preferred over a larger number of "narrow" (e.g. 30°–90° of periphery) recesses. Further, while substantially rectangular recesses are preferred for many purposes, other forms, e.g. polygonal, circular or oval could be used as well.

Figure 2:
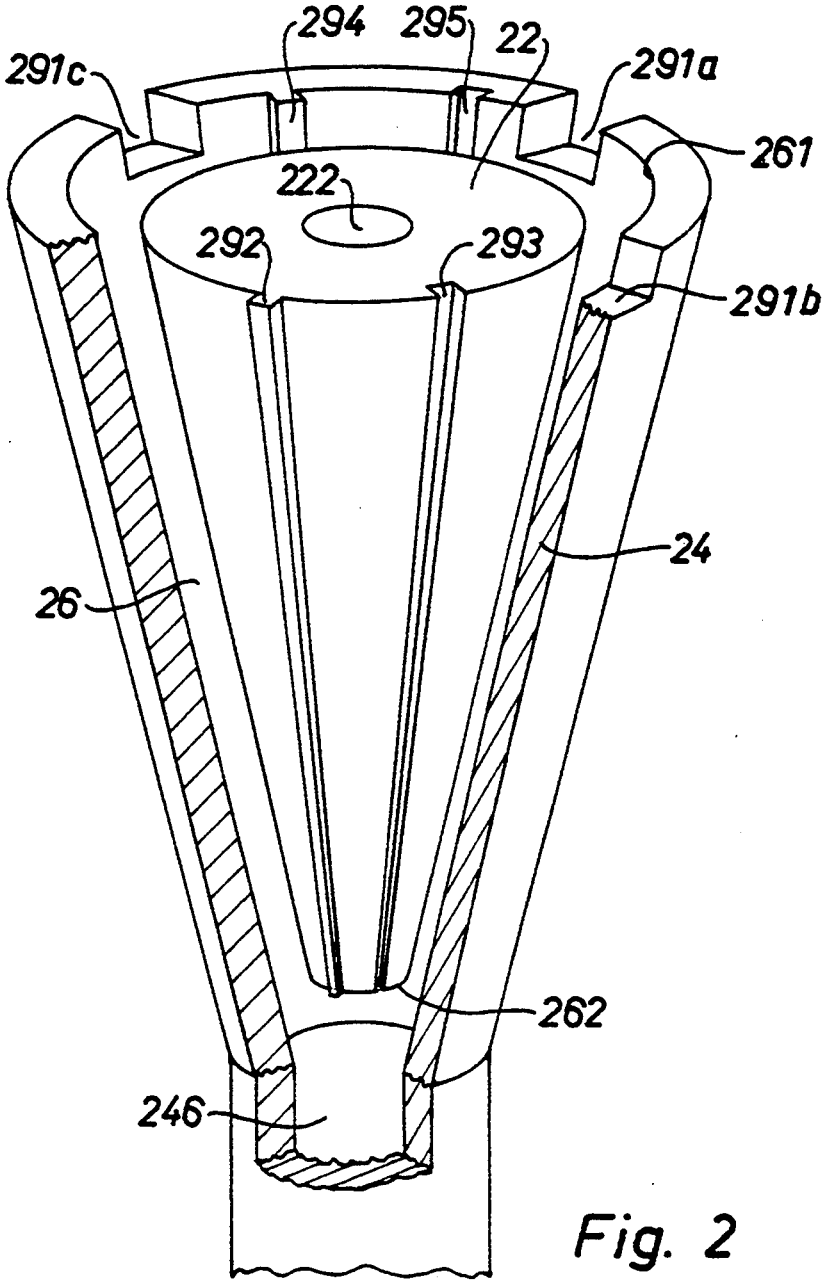
FIG. 2 is a diagrammatic and broken-away perspective view to illustrate various means of dynamic gap flow control according to the invention.

FIG. 2 is a diagrammatic perspective view illustrating a gap 26 having an upper end 261 and a lower end 262 formed between the adjacent wall portions of an inner nozzle member 22 and an outer nozzle member 24. As is apparent from FIG. 2, each axial recess 291 will reduce the length of gap 26 below the corresponding recess so as to cause a pressure drop or pressure differential in that gap area; in an analogous manner, pressure differentials could also be caused by axial recesses 293,295 and/or axial protrusions in either or both the inner 22 and outer 24 nozzle member. According to another embodiment of the invention, perforations (not shown in FIG. 2) of the wall of the outer nozzle member 26 could be used as a means to cause at least one and preferably at least two pressure differential areas of gap 26. Regarding size, shape and number of recesses, protrusions and perforations, few effective means of this type are frequently preferred over more and less effective ones. In view of ease of manufacture, inner and outer nozzle members with essentially smooth surfaces in the gap forming areas are preferred for many purposes.

Operational tests made with a nozzle devices of the type shown in FIGS. 1A, 1B and 1C have shown that uniform colour effects can be achieved and/or that filament portions of different polymers, such as polyamides and/or polyesters and/or polyakylenes can be successfully textured and/or intermingled with nozzle devices according to the invention.

Various modifications of the above examples will be apparent to those skilled in the art. For example, while yarn processing or production is a preferred field of application, other types of solid streams could be processed if dynamic gap flow control is known or suspected to be advantageous in continuous processing, e.g. to increase homogeneity, involving conveying of particulate or fibrous solids and intermixing them which each other and or with a gaseous or liquid fluid. Accordingly, gaseous fluids could be replaced by liquid fluids if required.

What I claim is:

1. A nozzle device suitable for a processing of synthetic yarns; said device compromising:

a housing having an inlet end and an outlet end;

said inlet end being located upstream in relation to said outlet end;

an inner nozzle member having a conical outer wall portion and an essentially axial passage;

an outer nozzle member having a conical inner wall portion; both said inner and said outer nozzle member being positioned within said housing;

said conical outer wall portion of said inner nozzle member and said inner wall portion of said outer nozzle member together forming a conical gap having an upstream end and a downstream end;

inlet means for passing a fluid into said housing and into a region thereof adjacent said upper end of said conical gap;

said conical gap having a cross-sectional area in any radial plane between said upstream end and said downstream end of said gap;

and means for providing at least one pressure-differential area within said cross-sectional area of said gap including at least one gap zone having a reduced radial width provided by a configuration of said outer nozzle member.

2. A nozzle device suitable for processing of synthetic yarns; said device comprising:

a housing having an inlet end and an outlet end;

said inlet end being located upstream in relation to said outlet end;

an inner nozzle member having a conical outer wall portion and an essentially axial passage;

an outer nozzle member having a conical inner wall portion; both said inner and said outer nozzle members being positioned within said housing;

said conical outer wall portion of said inner nozzle member and said inner wall portion of said outer nozzle member together forming a conical gap having an upstream end and a downstream end;

inlet means for passing a fluid into said housing and into a region thereof adjacent said upstream end of said conical gap;

said conical gap having a cross-sectional area in any radial plane between said upstream end and said downstream end of said gap;

and means for providing at least one pressure-differential area within said cross-sectional area of said gap;

wherein said outer nozzle member has at least one peripheral recess in an axial direction, near said upper end of said gap for providing at least one zone along said gap having a decreased flow resistance for said fluid medium.

3. A nozzle device suitable for processing of synthetic yarns; said device comprising:

a housing having an inlet end and an outlet end;

said inlet end being located upstream in relation to said outlet end;

an inner nozzle member having a conical outer wall portion and an essentially axial passage;

an outer nozzle member having a conical inner wall portion; both said inner and said outer nozzle members being positioned within said housing;

said conical outer wall portion of said inner nozzle member and said inner wall portion of said outer nozzle member together forming a conical gap having an upstream end and a downstream end wherein at least one elongated surface selected from the group of surfaces consisting of a ridge and a groove is provided on said inner wall portion of said outer nozzle member in a portion of said gap;

inlet means for passing a fluid into said housing and into a region thereof adjacent said upstream end of said conical gap;

said conical gap having a cross-sectional area in any radial plane between said upstream end and said downstream end of said gap;

and means for providing at least one pressure-differential area within said cross-sectional area of said gap.

4. A nozzle device suitable for processing of synthetic yarns; said device compromising:

a housing having an inlet end and an outlet end;

said inlet end being located upstream in relation to said outlet end; an inner nozzle member having a conical outer wall portion and an essentially axial passage; an outer nozzle member having a cortical inner wall portion; both said inner and said outer nozzle members being positioned within said housing;

said conical outer wall portion of said inner nozzle member and said inner wall portion of said outer nozzle member together forming a conical gap having an upstream end and a downstream end; inlet means for passing a fluid into said housing and into a region thereof adjacent said upstream end of said conical gap;

said conical gap having a cross-sectional area in any radial plane between said upstream end and said downstream end of said gap;

and means for providing at least one pressure-differential area within said cross-sectional area of said gap including at least one gap zone having a reduced radial width, wherein at least two areas of reduced axial length of said gap are provided in said outer nozzle member near said upper end of said gap to form an essentially symmetric distribution of alternatingly increased and decreased resistance of flow of said fluid medium along said gap forming said upper to said lower end thereof.

5. A nozzle device suitable for processing of synthetic yarns; said device comprising:

a housing having an inlet and and an outlet end;

said inlet end being located upstream in relation to said outlet end; an inner nozzle member having a conical outer wall portion and an essentially axial passage; an outer nozzle member having a conical inner wall portion; both said inner and said outer nozzle members being positioned within said housing;

said conical outer wall portion of said inner nozzle member and said inner wall portion of said outer nozzle member together forming a conical gap having an upstream end and a downstream end, wherein said inner nozzle member is a conical member having an axially extending central passage and comprising means for positioning within said housing relative to said outer nozzle member which is an elongated and substantially tubular member having said conical inner wall provided with a head portion having at least one elongated recess for permitting passage of said fluid to said upper end of said gap inlet means for passing a fluid into said housing and into a region thereof adjacent said upstream end of said conical gap;

said conical gap having a cross-sectional area in any radial plane between said upstream end and said downstream end of said gap;

and means for providing at least one pressure-differential area within said cross-sectional area of said gap.

6. A nozzle device suitable for processing of synthetic yarns, said device comprising:

a housing having an inlet end and an outlet end;

said inlet end being located upstream in relation to said outlet end;

an inner nozzle member having a conical outer wall portion and an essentially axial passage;

an outer nozzle member having a conical inner wall portion; both said inner and said outer nozzle members being positioned within said housing;

said conical outer wall section of said inner nozzle member and said inner wall portion of said outer nozzle member together forming a conical gap having an upstream end and a downstream end;

inlet means for passing a fluid into said housing and into a region thereof adjacent said upstream end of said conical gap;

said conical gap having a cross-sectional area in any radial plane between said upstream and said downstream end of said gap;

and means for providing at least one flow-differential area within each said cross-sectional area of said gap, said flow-differential area formed by including at least one first gap portion having a first axial length, and at least one second gap portion having a second axial length, said second axial length being smaller than said first axial length; said flow-differential area producing at least two areas of differing flow velocities of a jet stream of said fluid in said cross-sectional area in any of said radial planes; wherein at least two second gap portions having said second length are provided by axial recesses in said outer nozzle member near said upper end of said gap to form an essentially symmetric distribution of said at least two areas of differing flow velocities.

7. A nozzle device suitable for processing of synthetic yarns, said device comprising:

a housing having an inlet end and an outlet end;

said inlet end being located upstream in relation to said outlet end;

an inner nozzle member having a conical outer wall portion and an essentially axial passage;

an outer nozzle member having a conical inner wall portion; both said inner and said outer nozzle members being positioned within said housing;

said conical outer wall section of said inner nozzle member and said inner wall portion of said outer nozzle member together forming a conical gap having an upstream end and a downstream end;

inlet means for passing a fluid into said housing and into a region thereof adjacent said upstream end of said conical gap;

said conical gap having a cross-sectional area in any radial plane between said upstream and said downstream end of said gap;

wherein said inner nozzle member is a conical member having an axially extending central passage and comprising means for positioning within said housing relative to said outer nozzle member which is an elongated and substantially tubular member provided with a pair of indentations at opposite portions of said upper end of said gap, said indentations providing for a peripheral length of said indentations which is at least equal to the peripheral length of the non-indented portions of said tubular member provided with a pair of indentations at opposite portions of said upper end of said gap, said indentations providing for a peripheral length of said indentations which is at least equal to the peripheral length of the non-indented portions of said tubular member;

and means for providing at least one flow-differential area within each said cross-sectional area of said gap, said flow differential area formed by including at least one first gap portion having a first axial length, and at least one second gap portion having a second axial length, said second axial length being smaller than said first axial length; said flow-differential area producing at least two areas of differing flow velocities of a jet stream of said fluid in said cross-sectional area in any of said radial planes.

* * * * *